US007090932B2

(12) United States Patent
Kobayashi et al.

(10) Patent No.: US 7,090,932 B2
(45) Date of Patent: Aug. 15, 2006

(54) PLASMA RESISTANT MEMBER

(75) Inventors: Yoshio Kobayashi, Kanagawa (JP); Masahiko Ichishima, Aichi (JP); Yuu Yokoyama, Kanagawa (JP)

(73) Assignee: Toshiba Ceramics Co., Ltd., Tokyo (JP)

( * ) Notice: Subject to any disclaimer, the term of this patent is extended or adjusted under 35 U.S.C. 154(b) by 0 days.

(21) Appl. No.: 10/901,435

(22) Filed: Jul. 29, 2004

(65) Prior Publication Data

US 2005/0084692 A1 Apr. 21, 2005

(30) Foreign Application Priority Data

Jul. 29, 2003 (JP) ..... P.2003-202993
Jul. 2, 2004 (JP) ..... P.2004-196959

(51) Int. Cl.
*B32B 15/04* (2006.01)

(52) U.S. Cl. ..... 428/701; 428/699; 428/702; 428/469

(58) Field of Classification Search ..... 428/469, 428/701, 702, 697, 699, 446
See application file for complete search history.

(56) References Cited

U.S. PATENT DOCUMENTS 6,284,691 B1 * 9/2001 Bruce ..... 501/103

FOREIGN PATENT DOCUMENTS

| | | | |
|---|---|---|---|
| JP | 10-045467 A | | 2/1998 |
| JP | 11-157916 A | | 6/1999 |
| JP | 2001051338 | * | 9/2002 |
| JP | 2001248463 | * | 2/2003 |

* cited by examiner

*Primary Examiner*—Jennifer McNeil
(74) *Attorney, Agent, or Firm*—Foley & Lardner LLP

(57) ABSTRACT

A plasma resistant member has a base material and a coating layer made of an $Y_2O_3$, the coating layer being formed on a surface of the base material. The coating layer has a thickness of 10 μm or more and the $Y_2O_3$ of the coating layer contains solid solution Si ranging from 100 ppm to 1000 ppm.

12 Claims, 5 Drawing Sheets

PLASMA RESISTANT MEMBER

BACKGROUND OF THE INVENTION

1. Field of the Invention

This invention relates to a plasma resistant member that is used as a constituent member of a semiconductor manufacturing apparatus, a liquid crystal manufacturing apparatus, and the like.

2. Description of the Related Art

In manufacturing semiconductors and liquid crystals, many processes using fluorine plasmas in etching and cleaning wafers and so forth are used. Usually, chamber walls of an apparatus used in these processes are made of aluminum. However, aluminum reacts with fluorine plasma to thereby produce an Al—F compound. This compound is changed into particles that adversely affect devices. To prevent this, hitherto, the reaction to the fluorine plasma has generally been suppressed by using alumina ceramics in the region of a chamber whose plasma exposure conditions are severe, or by providing an alumite coat thereon.

However, with recent enhancement of performance of devices, the use of alumina ceramics and an alumite coat of conventional techniques have caused problems. This is, because of the facts that recent progresses of micro-fabrication have promoted employment of high-vacuum plasma, that thus, alumina exposed to higher-density fluorine plasma are greatly abraded. Consequently, an amount of produced Al—F particles is not ignorable.

The possibilities of using Yttria, YAG ($Y_3Al_5O_{12}$), and the like as a member, which produces no Al—F particles, instead of alumina have been considered. There has been a trend toward gradual increase in utilization of Yttria thereamong. In this case, Yttria has also been utilized as bulk ceramics. Alternatively, a surface of an existing material is coated therewith by utilizing thermal spraying. The method of forming an Yttria coat by utilizing the thermal spraying has less influence on the processes and is achieved at relatively low cost. Thus, the use of the plasma-resistant member, the surface of the base material of which is coated with Yttria, gradually increases under present circumstances.

There are various methods, such as a thermal spraying method, a CVD method, and a PVD method, for forming an $Y_2O_3$ coat on the surface of the base material. In consideration of the cost and the thickness of the formed layer, the thermal spraying method is evaluated to be highly practical. In the case of using a coating layer formed by the thermal spraying method as a plasma resistant layer, the denseness and the adhesion strength thereof are important factors. If a layer whose denseness is low and porosity is high, the etching rate thereof is high. Further, if a through hole, which reaches the base material, is present in the layer, the layer cannot function as a protective one. In a case where the adhesion strength between the layer and the base material is low, there is a possibility of peel-off thereof due to stress that is generated by energy received from the plasma. The peel-off of the coating layer causes problems that the coating layer becomes a source of particles, and that the base material is exposed.

Japanese Patent Unexamined Publication JP-A-10-45467 discloses corrosion-resistant member, whose part to be exposed to a fluorine-corrosive gas or a plasma thereof is made of a composite oxide including a metal of the group 3*a* of the periodic table and Al and/or Si. Japanese Patent Unexamined Publication JP-A-11-157916 discloses a corrosion-resistant member, whose part to be exposed to a chlorine-corrosive gas or a plasma thereof is made of a composite oxide including a metal of the group 3*a* of the periodic table and Al and/or Si.

However, according to a conventional technique of JP-A-10-45467, a part to be exposed to fluorine plasma is made of a composite oxide containing a metal of the group 3*a* of the periodic table and Si. This composite oxide is a sintered compact of a garnet crystal, such as YAG, a single crystal, such as YAM, a perovskite crystal, and monosilicate. This document does not disclose that a coating layer is formed of $Y_2O_3$. Also, conventional technique of JP-A-11-157916 is nearly equivalent to that of JP-A-10-45467. A part, at which a composite oxide is formed, is that to be exposed to a fluorine-corrosive gas or to plasma thereof. Therefore, the conventional technique differs from the present invention in this respect.

SUMMARY OF THE INVENTION

One of the objects of the present invention is to provide a plasma resistant member used as a chamber wall or the like of an apparatus used in a semiconductor manufacturing process. By forming a coating layer with an $Y_2O_3$ contains solid solution Si, a melting point of the $Y_2O_3$ decreases and enables to perform thermal spray uniformly to thereby enhance adhesiveness to the base material. Also, because of an uniform erosion of the $Y_2O_3$ layer, good corrosion resistance is obtained. Using an $Y_2O_3$ containing solid solution Si, it enables to prevent a crystal grain from falling and also enables to reduce the generation of particles.

According to a first aspect of the present invention, there is provided a plasma resistant member having a base material and a coating layer made of an $Y_2O_3$, the coating layer being formed on a surface of the base material. The coating layer has a thickness of 10 μm or more and the $Y_2O_3$ of the coating layer contains solid solution Si ranging from 100 ppm to 1000 ppm.

According to a second aspect of the present invention, the coating layer is formed by thermal spraying with an $Y_2O_3$ containing a solid solution Si ranging from 100 ppm to 1000 ppm.

According to a third aspect of the present invention, the base material is aluminum.

According to a fourth aspect of the present invention, the solid solution Si is in an $Y_2O_3$ crystal.

According to the present invention, when forming a coating layer as a plasma resistant member on the surface of the base material, by using a $Y_2O_3$ containing a solid solution Si ranging from 100 ppm to 1000 ppm as a thermal spray agent, the melting point of the $Y_2O_3$ lowers and uniform thermal spray is enabled. Also, when the $Y_2O_3$ layer is corroded, the corrosion is uniformly occurred, as a result, it enhances a corrosion resistance. Further, using a $Y_2O_3$ film containing a solid solution Si ranging from 100 ppm to 1000 ppm as a thermal spray agent, there are provided advantages that the crystal grain is prevented from falling and therefore the generation of the particles is reduced. Furthermore, commercial merits are larger because the plasma resistant member is easily formed by thermal spray.

DETAILED DESCRIPTION OF THE PREFERRED EMBODIMENTS

Figure 1:
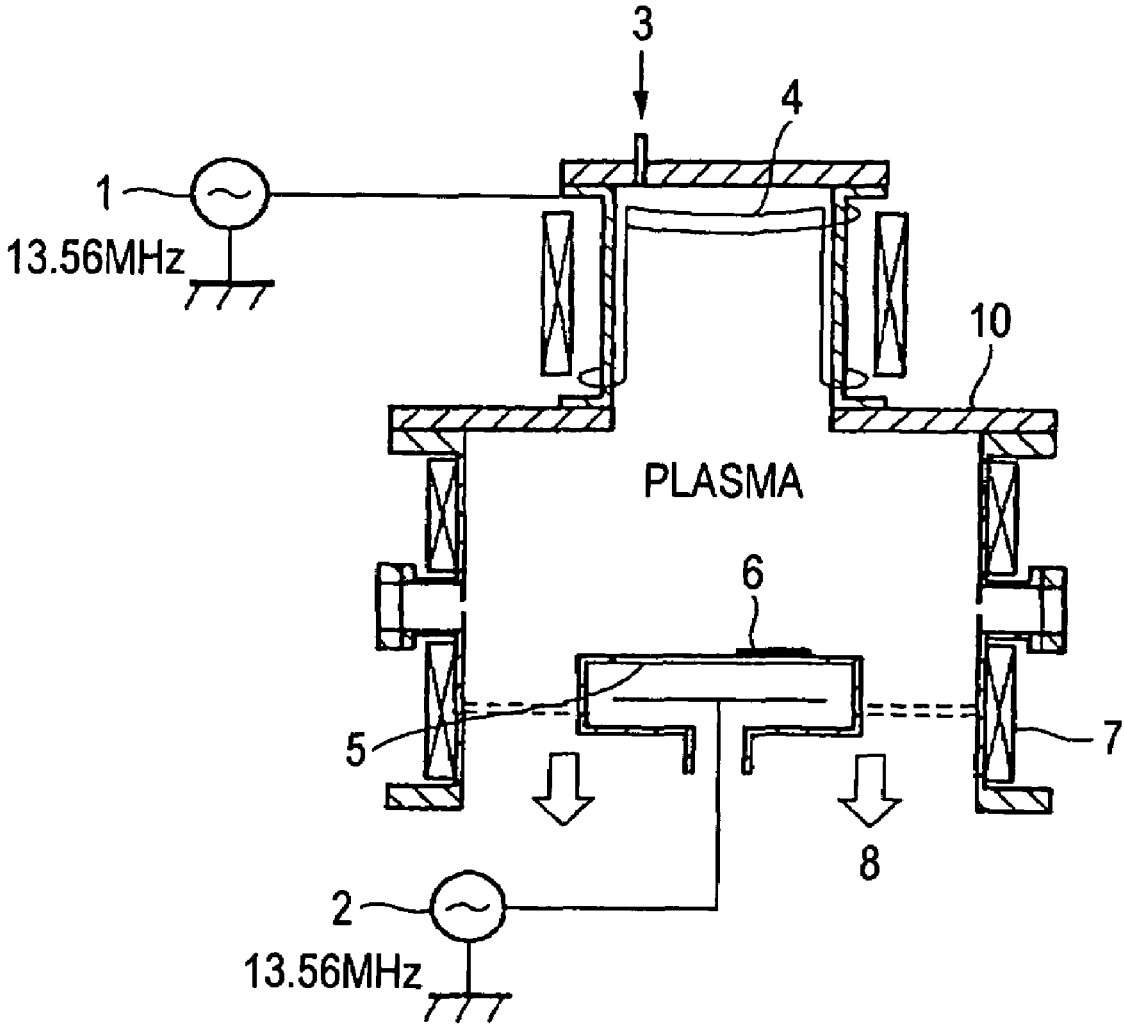
FIG. 1 is a side sectional view showing a plasma etching apparatus to which a coating layer according to the invention can be applied.

According to the invention, a plasma-resistant member, which is used in chamber walls and the like of a fluorine plasma apparatus to be used for etching and cleaning performed in a process of manufacturing semiconductors and liquid crystals, and which is a plasma-resistant $Y_2O_3$ protective film having good adhesiveness to the substrate, is formed.

A plasma resistant $Y_2O_3$ coating layer of the present invention is an $Y_2O_3$ layer containing a solid solution Si ranging from 100 to 1000 ppm. To form the coating layer, a thermal spray method is adopted. When performing the thermal spray method, an $Y_2O_3$ contains solid solution Si is sprayed. Owing to an existence of a small amount of the solid solution Si, the melting point of the $Y_2O_3$ lowers to thereby enable to form uniformly molten particles at the spraying thereof. Especially, owing to the solid solution Si, the lowering of the melting point of $Y_2O_3$ can suppress an occurrence of a phenomenon in which droplets thereof start coagulating before reaching the base material. Thus, a dense layer made of an $Y_2O_3$ is formed, so that the adhesion strength between the base material and the coating layer is increased.

Furthermore, owing to the existence of the solid solution Si in the $Y_2O_3$, there are advantages that the corrosion of the $Y_2O_3$ coating layer is not partial but also uniformly occurred to enhance the corrosion resistance, and preventing the crystal grain from falling, therefore the generation of the particle is reduced. On the other hand, in a case that Si is segregation in the crystalline grain boundary instead of Si being not solid solved in $Y_2O_3$, the segregated $Y_2O_3$ is selectively corroded by fluorine gas, the surface of the coating layer receives damages and the $Y_2O_3$ crystals of surface of the coating layer fall and the generation of the particle is increased. For obtaining $Y_2O_3$ containing small amount of solid solution Si, for example, it is adoptable to mix an $Y_2O_3$ powder and a Si powder, and performing heat treatment in heat treatment furnace with $N_2$ atmosphere at 1000° C. for 10 hours.

An amount of solid solution Si is less than 100 ppm, there are less effective of lowering melting point of the $Y_2O_3$, and the amount excess 1000 ppm, Si forms a second layer. An existence of the second layer is not preferable because the formation of portions has inferior plasma resistance. It is not preferable for manufacturing semiconductor or liquid crystal to contain metal elements other than Si because they make the plasma resistance lower.

EMBODIMENT EXAMPLE 1

A $Y_2O_3$ sprayed layer was made on the aluminum base material, whose purity was 99.9%, by using granulated powder constituted by raw material powder including solid solution Si whose content was 300 ppm. The porosity of this sprayed layer was 2.2%, and the adhesion strength thereof was 268 kgf/cm$^2$. Further, only $Y_2O_3$ crystals were confirmed by the X-ray diffraction.

On this thermal sprayed layer, performed etching by well-known normal plasma etching device as shown in FIG. 1. In FIG. 1, a reference number 1 and 2 denote a high frequency generator, 3 denotes fluorine gas, 4 denotes an antenna, 5 denotes a crystal wafer, 6 denotes a sample, 7 denotes a magnet and 10 denotes a plasma etching apparatus. An etching condition is as below.

Etch gas; $CF_4$(100 sccm)

Pressure; 4 mTorr

High frequency power; Source RF 500W, Bias RF 40 W

Treatment time; 4 hour

Each sample was put on a quartz glass wafer placed on a part on which a wafer is usually put.

EMBODIMENT EXAMPLE 2

An $Y_2O_3$ sprayed layer was made on the aluminum base material, whose purity was 99.9%, by using granulated powder including solid solution Si, whose content was 800 ppm. The porosity of this sprayed layer was 2.0%, and the adhesion strength thereof was 232 kgf/cm$^2$. Further, only $Y_2O_3$ crystals were confirmed by the X-ray diffraction.

COMPARATIVE EXAMPLE 1

A $Y_2O_3$ sprayed layer was made on the aluminum base material, whose purity was 99.9%, by using granulated powder constituted by raw material powder including solid solution Si whose content was 50 ppm. The porosity of this sprayed layer was 4.3%, and the adhesion strength thereof was 137 kgf/cm$^2$. Further, only $Y_2O_3$ crystals were confirmed by the X-ray diffraction.

COMPARATIVE EXAMPLE 2

An $Y_2O_3$ sprayed layer was made on the aluminum base material, whose purity was 99.9%, by using granulated powder including solid solution Si, whose content was 1500 ppm. The porosity of this sprayed layer was 2.4%, and the adhesion strength thereof was 198 kgf/cm$^2$. Further, in addition to the presence of $Y_2O_3$ crystals, the presence of a small amount of $Y_2SiO_5$ crystals was confirmed by the X-ray diffraction.

Figure 2:
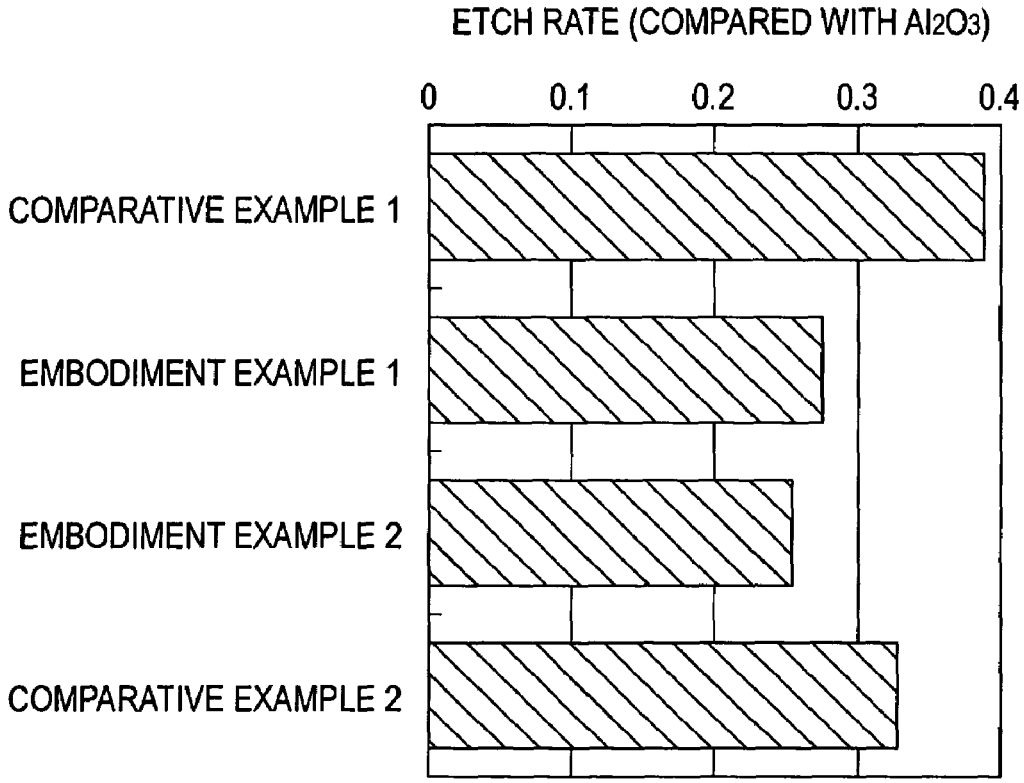
FIG. 2 is a graph showing an etching rate of each of coating layer according to the invention and coating layer of comparative examples, in terms of a rate thereof to that of alumina.

Results of etching performed on thermal sprayed layer of Embodiment Example 1 and 2 and Comparative Example 1 and 2 are shown in FIG. 2 using an etching rate (E/R) that is a rate of an etching amount of each sample to an etching amount of $Al_2O_3$. The etching amount is calculated from the differences between a masked portion of the samples and an exposure portion of the samples. As shown in FIG. 2, according to the present invention, the porosity ratio of the coating layer of the present invention is low and the adhesive resistance of the present invention is excellent, as a result, the etching amount is extremely low.

COMPARATIVE EXAMPLE 3 and 4

Figure 3:
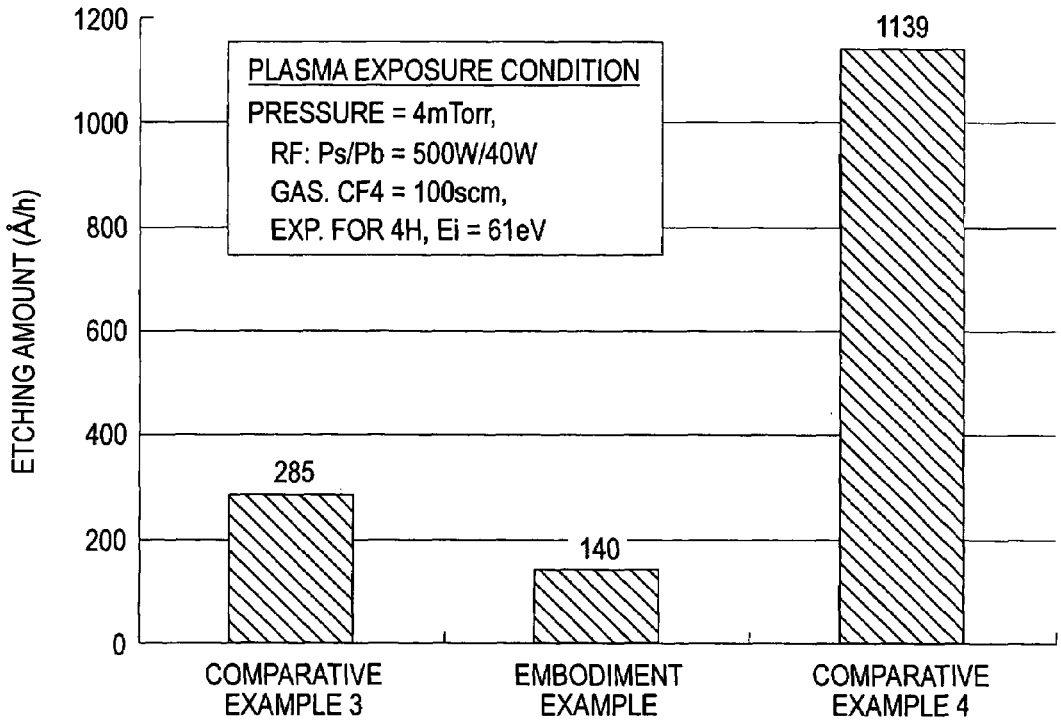
FIG. 3 is a graph showing a relation of the etching amount among each Yttria sprayed layers and aluminum.

An $Y_2O_3$ sprayed layer (an Yttria sprayed layer including Si) was made on the aluminum base material, whose purity was 99.9%, by using granulated powder obtained by mixing raw material powder including not solid solution Si, with fine powder of $SiO_2$ SO that a total amount of Si was 500 ppm. The porosity of this sprayed layer was 3.0%, and the adhesion strength thereof was 120 kgf/cm$^2$. Further, $Y_2O_3$ crystals and small amount of $SiO_2$ crystals were confirmed by the X-ray diffraction. An etching similar to the Embodiment Example was performed on this sprayed layer to measure the etching amount. FIG. 3 shows the result comparing with the sprayed layer of the Embodiment Example 1, Comparative Example 3 and the sprayed layer of the conventional $Al_2O_3$ base material (Comparative Example 4). As shown in FIG. 3, the etching amount of the Embodiment Example 1 is half of the sprayed layer of the comparative Example 3.

Figure 4A:
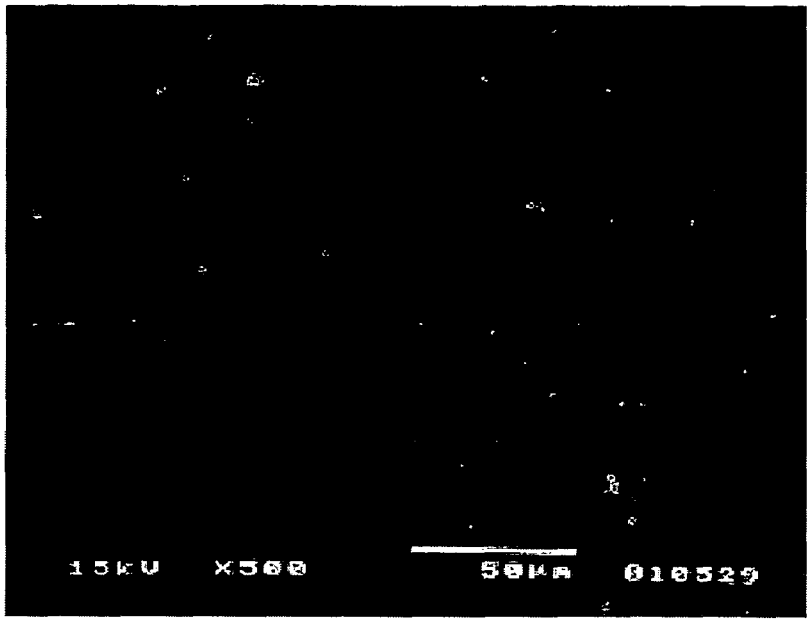
FIG. 4A is a SEM microphotograph of a cutting plane of a solid solution Si included Yttria sprayed layer before etching.
Figure 4B:
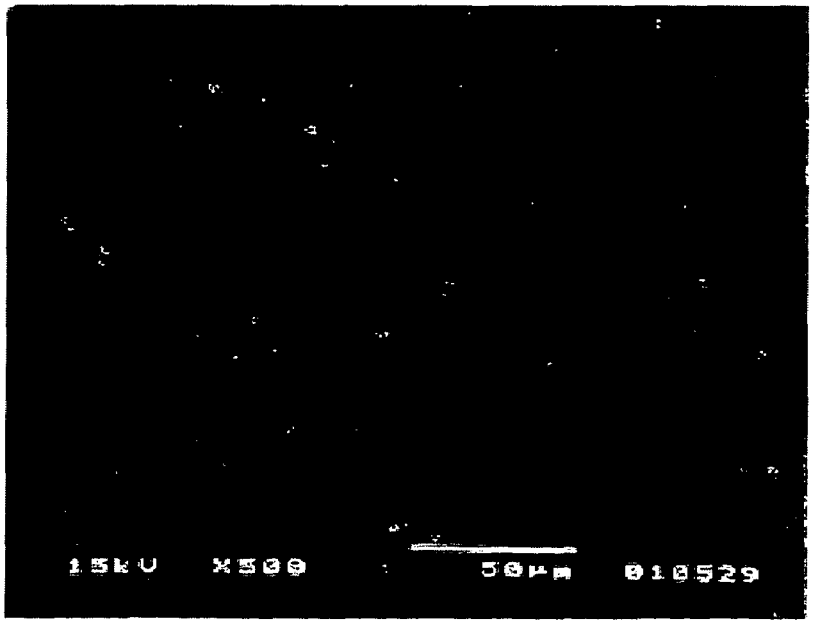
FIG. 4B is a SEM microphotograph of a cutting plane of a solid solution Si included Yttria sprayed layer after etching.

FIGS. 4A and 4B each shows a microphotograph of cutting plane of the Yttria sprayed layer containing the solid solution Si of the Embodiment Example 1. FIG. 4A is a SEM photograph showing a polished surface of the cutting plane of the sprayed layer before etching and FIG. 4B is a SEM photograph showing the same surface of the polished surface of the cutting surface after etching.

Figure 5A:
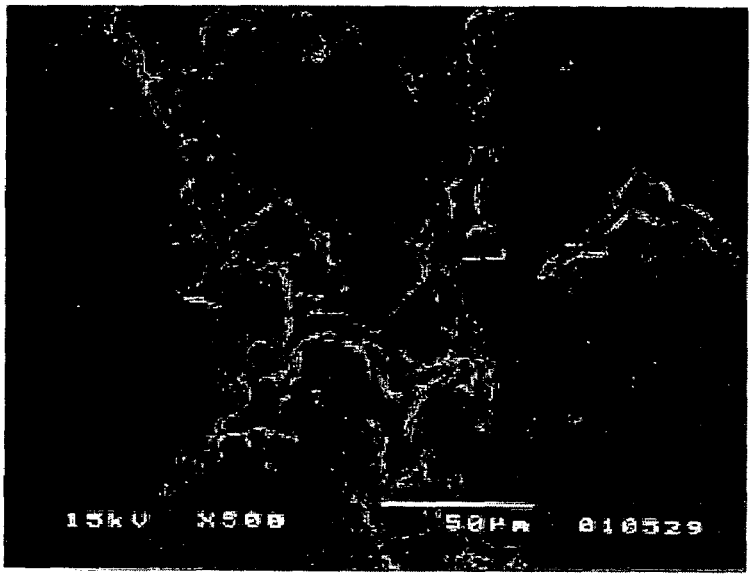
FIG. 5A is a SEM microphotograph of a cutting plane of a Si included Yttria sprayed layer before etching.
Figure 5B:
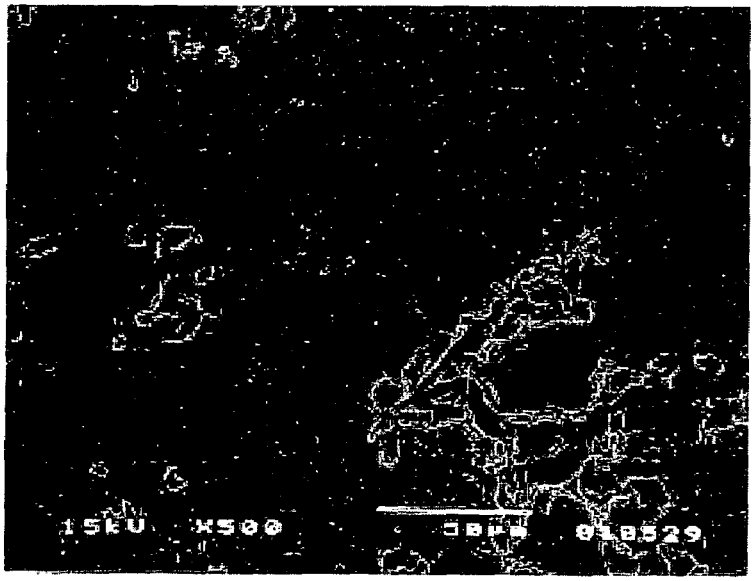
FIG. 5B is a SEM microphotograph of a cutting plane of a Si included Yttria sprayed layer after etching.

FIGS. 5A and 5B each shows a microphotograph of cutting plane of the Yttria sprayed layer including the Si of the Comparative Example 3. FIG. 5A is a SEM photograph showing a polished surface of the cutting plane of the sprayed layer before etching and FIG. 5B is a SEM photograph showing the same surface of the polished surface of the cutting surface after etching.

As clearly shown in FIGS. 4A to 5B, in the Yttria sprayed layer containing the solid solution Si, there are almost no partial corrosions, however, in the Yttria sprayed layer containing no solid solution Six there are much partial corrosions after etching.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

According to the invention, in apparatuses for manufacturing semiconductors and liquid crystals, a sprayed layer, which has small porosity and high adhesion strength and is dense, can be formed on a part, whose plasma exposure conditions are severe. Thus, even under severe plasma radiating conditions, the etch rate is low, so that the peel-off of the layer to be caused by the stress, which is produced by a thermal history due to the plasma can be suppressed. Consequently, the generation of particles due to this peel-off can be prevented. Additionally, according to the invention, such an $Y_2O_3$ coating layer can easily be formed by the thermally spraying. Thus, a large economic advantage can be obtained.

What is claimed is:

1. A plasma resistant member, comprising a base material; and a coating layer made predominantly of an $Y_2O_3$, the coating layer being formed on a surface of the base material, wherein the coating layer has a thickness of 10 μm or more and the $Y_2O_3$ of the coating layer contains solid solution Si ranging from 100 ppm to 1000 ppm.

2. The plasma resistant member as set forth in claim 1, wherein the coating layer is formed by thermal spraying with an $Y_2O_3$ containing a solid solution Si ranging from 100 ppm to 1000 ppm.

3. The plasma resistant member as set forth in claim 1, wherein the base material consists essentially of aluminum.

4. The plasma resistant member as set forth in claim 1, wherein the solid solution Si is in an $Y_2O_3$ crystal.

5. The plasma resistant member as set forth in claim 1, wherein the base material is a high purity aluminum.

6. The plasma resistant member as set forth in claim 5, wherein the high purity aluminum has a purity of 99.8%.

7. The plasma resistant member as set forth in claim 1, wherein the coating layer is formed directly on the surface of the base material.

8. The plasma resistant member as set forth in claim 1, wherein the coating layer is formed directly on the surface of the base material without any second layer.

9. The plasma resistant member as set forth in claim 1, wherein the coating layer consists essentially of $Y_2O_3$ and said solid solution Si.

10. A plasma etching apparatus, comprising:

a chamber including a wall, wherein the wall is the plasma resistant member according to claim 1.

11. A plasma etching apparatus, comprising:

a chamber including a wall, wherein the wall is the plasma resistant member according to claim 1, and wherein the plasma etching apparatus is adapted for use in etching semiconductors.

12. A plasma etching apparatus, comprising:

a chamber including a wall, wherein the wall is the plasma resistant member according to claim 1, and wherein the plasma etching apparatus is adapted for use in manufacturing at least one of semiconductors and liquid crystals.

* * * * *